United States Patent [19]

Eiklor et al.

[11] Patent Number: 5,033,455

[45] Date of Patent: Jul. 23, 1991

[54] GAS-FIRED ARTIFICIAL LOG BURNERS

[76] Inventors: Scott F. Eiklor, 11711 Kenneth, Box 861; Steve F. Eiklor, 10809 N. Church, Box 804, both of Huntley, Ill. 60142

[21] Appl. No.: 605,973

[22] Filed: Oct. 30, 1990

Related U.S. Application Data

[63] Continuation-in-part of Ser. No. 488,321, Mar. 5, 1990, abandoned.

[51] Int. Cl.[5] ..... F23C 3/00

[52] U.S. Cl. ..... 126/512; 239/553; 126/500; 126/540

[58] Field of Search ..... 431/125; 126/92 R, 92 AC, 126/500, 512, 524, 540; 239/553

[56] References Cited

U.S. PATENT DOCUMENTS

| | | | |
|---|---|---|---|
| 1,630,109 | 5/1927 | Chandler | 126/92 R |
| 3,362,395 | 1/1968 | Peterson | 126/92 R |
| 3,583,845 | 6/1971 | Pulone | 431/125 |
| 3,671,175 | 6/1972 | Campbell . | |
| 3,806,306 | 4/1974 | Duperow et al. | 431/193 |
| 3,871,355 | 3/1975 | Henry | 126/127 |
| 4,306,537 | 12/1981 | Mitchell | 126/92 AC |
| 4,582,478 | 4/1986 | Hilker | 431/125 |
| 4,637,372 | 1/1987 | Mogol et al. | 126/127 |

*Primary Examiner*—Carroll B. Dority

*Attorney, Agent, or Firm*—Wallenstein, Wagner & Hattis, Ltd.

[57] ABSTRACT

The invention is a gas-fired burner for a fireplace, including an upper burner comprised of an upper tubular gas pipe and a lower burner comprised of a lower tubular gas pipe. The upper and lower tubular gas pipes meet at a junction, where gas to the lower tubular gas pipe is fed through the upper tubular gas pipe. Each of the tubular gas pipes has downwardly-facing, in-line orifices along their lengths. The improvement comprises a metallic strip having a width approximately equal to the inner diameter of the lower tubular gas pipe. This metallic strip is secured at its lateral ends to the interior of the lower pipe, and extends from a point adjacent the junction to a point beyond approximately the first twenty-five to thirty-three percent (25-33%) of the in-line orifices in the lower tubular gas pipe.

11 Claims, 2 Drawing Sheets

GAS-FIRED ARTIFICIAL LOG BURNERS

RELATED APPLICATIONS

This application is a continuation-in-part application of Ser. No. 07/488,321, filed on Mar. 5, 1990, and abandoned as of the Oct. 30, 1990, filing date of this application.

DESCRIPTION

Technical Field

This invention relates to improvements in gas-fired burners for fireplaces. In particular, the invention relates to improvements in gas distribution in a lower burner tubular gas pipe, and to improvements in distributing the aromatic smoke products of scented sticks.

BACKGROUND OF THE INVENTION

Gas-fired burners for fireplaces are well-known. In a typical gas-fired burner, the device comprises an upper burner including an upper tubular gas pipe and a lower burner including a lower tubular gas pipe. One such prior art device is disclosed in our now abandoned U.S. patent application Ser. No. 221,680, filed in 1988. In this device, the upper and lower tubular gas pipes meet at a junction. Gas to the lower tubular gas pipe is fed through the upper tubular gas pipe and then through a regulatory orifice at this junction. This regulatory orifice is most preferably a #53 orifice, but can also be a #56 orifice. Both of these tubular gas pipes have a plurality of downwardly-facing, in-line orifices along their lengths.

The lower tubular gas pipe generally runs horizontally above and along the length of a fireplace grate. Silica sand is placed on that grate in amounts sufficient to completely cover the lower tubular gas pipe. As the pressurized gas is discharged from the lower pipe, it moves upwardly through channels in the sand created by the gas. After the gas is ignited, the resulting flames create, with the aid of artificial logs and other visual aids, the illusion of a conventional, wood-burning fireplace with glowing embers on the sand.

In the prior art device disclosed in our now abandoned application, the lower gas pipe includes approximately twenty-six (26) of these downwardly-facing, in-line orifices. Because these orifices are spaced on ¾ inch centers and are of approximately the same size, i.e., preferably #32, a disproportionately large amount of the gas entering the lower tubular gas pipe is discharged through the first ¼ or about seven (7) of these orifices. As a result, the amount of gas discharged through the remaining nineteen orifices is disproportionately low. Thus, the flames in the areas of the fireplace adjacent the downstream regions of the lower gas pipe are not as intense as those adjacent the upstream regions of that pipe. This imbalance in gas distributors detracts from the realism of the gas-fired fireplace.

Because it uses artificial logs, such gas-fired fireplaces do not emit the pleasing scents inherent in the burning of wood logs. Scented sticks that emit the aroma of burning wood upon heating are known in the art. However, there are no known suitable means for effectively circulating the odors from such scented sticks which may be used in conjunction with gas-fired fireplaces. As will become apparent, the present invention also solves this problem.

SUMMARY OF THE INVENTION

The present invention is an improvement in gas-fired burners for use with an artificial, gas-burning fireplace. The invention includes an upper burner comprised of an upper tubular gas pipe, and a lower burner comprised of a lower tubular gas pipe. The upper and lower tubular gas pipes meet at a junction. At this junction, gas to the lower tubular gas pipe is fed from the upper tubular gas pipe. Each of these tubular gas pipes has downwardly-facing, in-line orifices distributed along their lengths. For improvement in gas distribution and more realistic flames simulating a wood burning fireplace, a metallic strip having a width approximately equal to the inner diameter is placed in the first lower tubular gas pipe. The metallic strip is secured at its lateral ends to the interior of the lower pipe, and extends from a point adjacent the junction to a point beyond approximately the first twenty-five to thirty-three percent (25–33%) of the in-line orifices in the lower tubular gas pipe.

In yet another embodiment, the gas burner includes a deflector band secured within the upper tubular gas pipe and adjacent to the junction. The deflector band curves upwardly to non-turbulently deflect gas within the upper tubular gas pipe into the lower tubular gas pipe for improved gas distribution.

In still another embodiment, the gas-fired burner further comprises a plurality of crossbars along its upper end. These crossbars are heated during use of the burner, and at least one of the crossbars is hollow. A scented stick is inserted into a open end of the hollow crossbar. Upon heating of the crossbar, the scented stick releases its aroma. Air within the hollow crossbar expands and escapes from the crossbar through its open end upon heating, thereby circulating the aromatic components of the scented stick.

Alternatively, the gas-fired burner may include a conventional and known V-shaped trough. Attached to this trough, however, for release of the aromatic elements of the scented stick is a novel and generally C-shaped carrier. Preferably, this carrier is secured adjacent the upper end of that trough where heat will cause it to smolder and smoke.

Accordingly, an object of the present invention is a device for ensuring more even release and distribution of natural gas or propane gas in gas-fired fireplaces. A further object is a means for more thorough circulation of the aromatic elements from a heat-actuated, scented stick.

DETAILED DESCRIPTION OF THE PREFERRED EMBODIMENT

Figure 1:
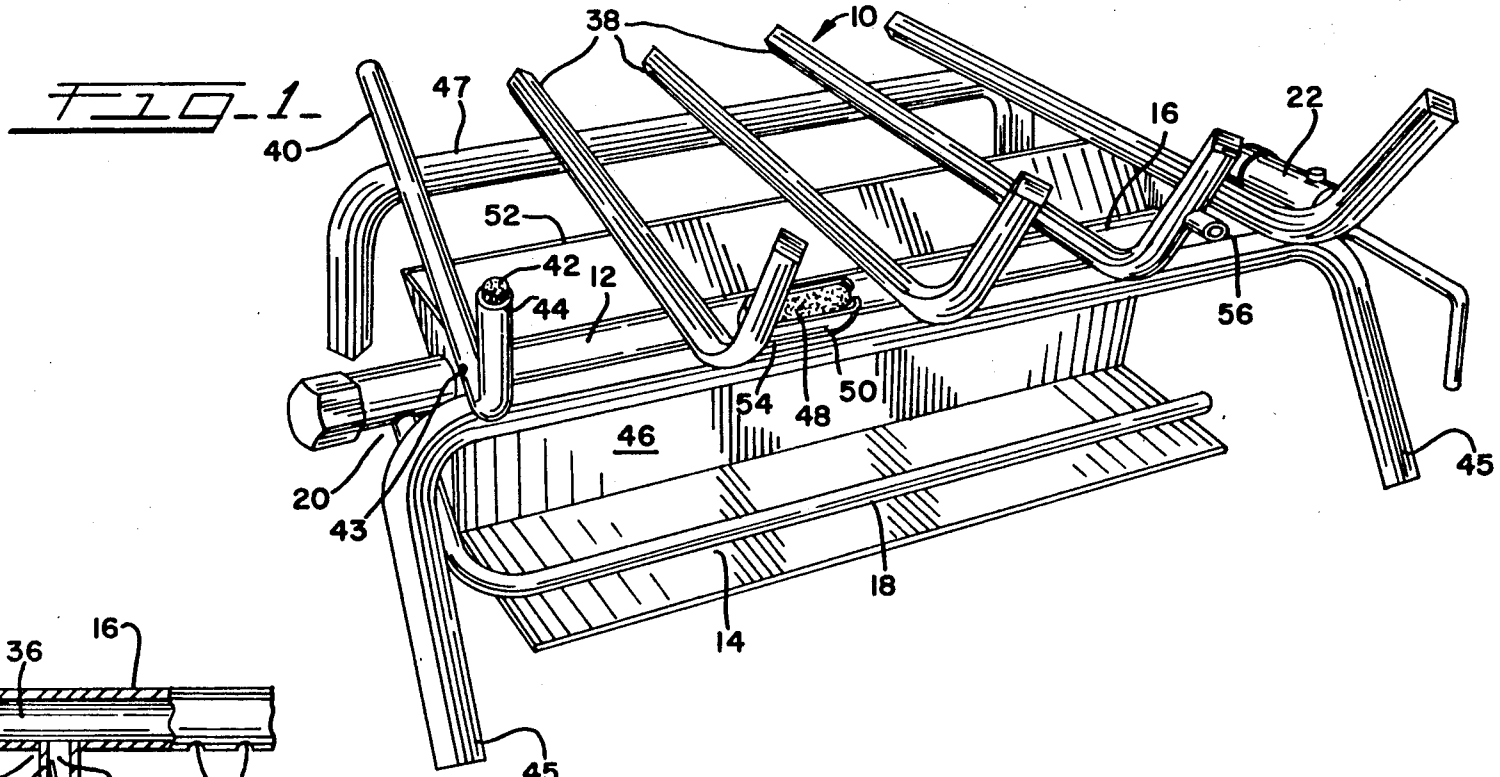
FIGURE 1 is a perspective view of a gas-fired burner for a fireplace in accordance with the invention.

The present invention relates to an improvement in a gas-fired burner for a fireplace. Although it may be best seen in FIG. 1, at least a portion of the gas-fired burner 10 of the present invention is shown in each of the figures. Referring now to FIG. 1, the gas-fired burner 10 comprises an upper burner 12 and a lower burner 14. The upper burner 12 includes an upper tubular gas pipe 16, and the lower burner 14 includes a lower tubular gas pipe 18. In a preferred embodiment, this upper tubular gas pipe 16 has an inner diameter of approximately ¾ inch and the lower tubular gas pipe 18 has an approximate inner diameter of ⅜ inch.

Figure 2:
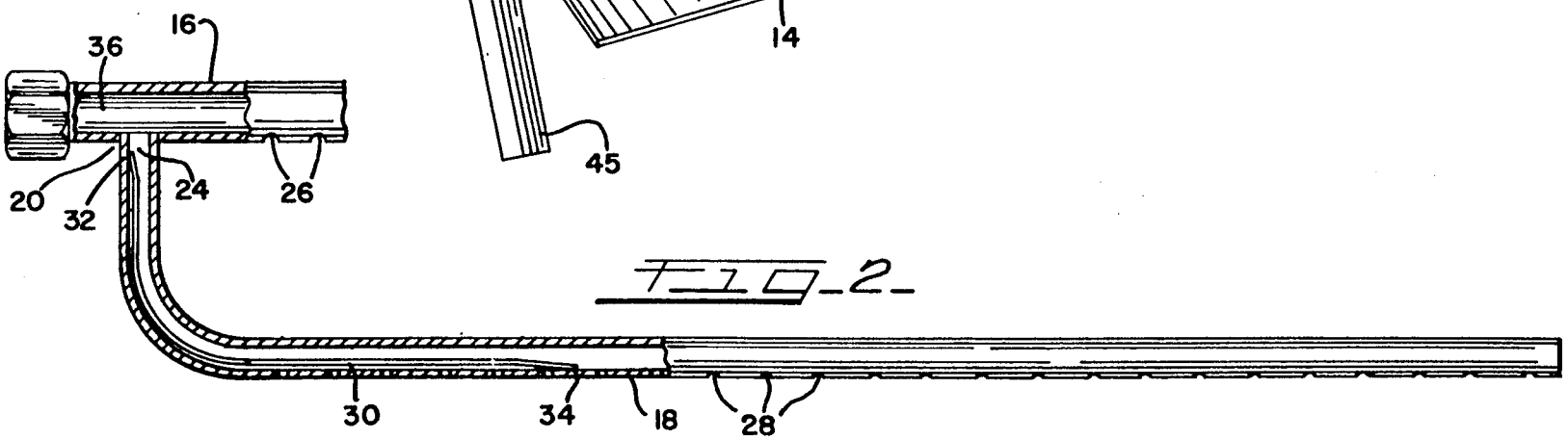
FIG. 2 is a partial sectional view of a portion of an upper burner and the entire lower burner of the gas-fired burner of the present invention.
Figure 3:
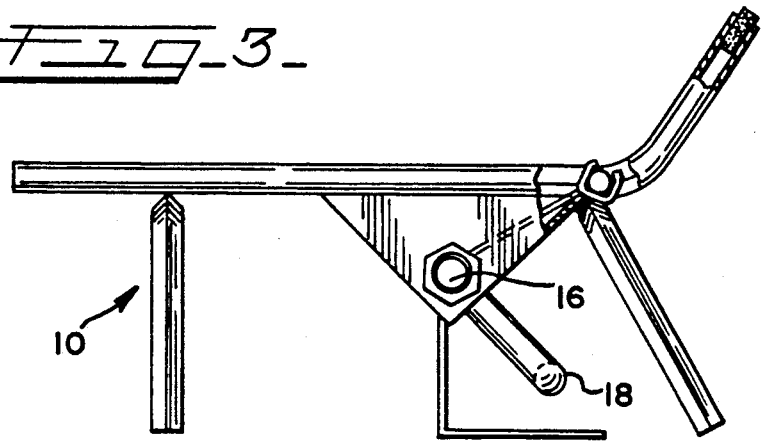
FIG. 3 is a side view, partially in section, of the gas-fired burner of FIG. 1.

Referring now to FIG. 2, the upper 16 and lower tubular gas pipes 18 meet at a junction 20. A source of natural or propane gas is supplied to the gas-fired burner 10 through a conventional gas supply valve 22. When opened, this gas supply valve 22 feeds the upper tubular gas pipe 16. Gas which is not discharged from the upper tubular gas pipe 16 moves towards junction 20, where it passes through a regulatory orifice 24. This regulatory orifice 24 controls the volume and pressure of gas being fed into the lower tubular gas pipe 18. In the present embodiment, this regulatory orifice 24 is either a #53 or a #56 orifice, and is most preferably a size #53 orifice.

Each of the tubular gas pipes 16 and 18 has downwardly-facing, in-line orifices along their lengths. In particular, upper tubular gas pipe 16 has at least five (5) orifices 26 spaced along centers of approximately 3 inches, and each of these orifices 26 is sized between #30 and #34, preferably #32. Similarly, lower tubular gas pipe 18 has twenty-six (26) orifices 28 spaced along centers of approximately 3/4 inch, and each orifice 28 is also sized at between #30 and #34, preferably #32.

The improvement in the present invention comprises a metallic strip 30 having a width of approximately ⅜ inch, i.e., a width approximately equal to or somewhat less than the inner diameter of the lower tubular gas pipe 18. In the embodiment shown in FIG. 2, the metallic strip 30 is secured within the lower tubular gas pipe 18, but substantially offset from its axial center. For this reason, the metallic strip 30 can have a width that is less than the inner diameter of gas pipe 18.

In the FIG. 2 embodiment, the sides of the metallic strip 30 along the entire length of that strip 30 abut against the adjacent inner walls of the pipe 18. In addition, the lateral ends 32 and 34 of this metallic strip 30 are secured to the inner walls of that lower pipe 18. The metallic strip 30 itself extends from a point adjacent the junction 20 to a point beyond approximately the first twenty-five to thirty-three percent (25–33%) of the in-line orifices 26 in the lower tubular gas pipe 18. In the FIG. 2 embodiment, lateral end 34 of this metallic strip 30 is secured to the inner wall of lower pipe 18 at a point just beyond the seventh in-line orifice 26.

With this arrangement of metallic strip 30 along the inner walls of the loWer pipe 18, most of the gas entering the lower pipe 18 through the regulatory orifice 24 will flow above that strip 30, moving beyond these first seven (7) orifices 26 to the remaining nineteen (19) downstream orifices. However, even though the edges of the strip 30 closely abut the pipe 18, gaps between the strip 30 and pipe 18 result from the imperfections in their surfaces and shapes. An amount of gas sufficient to fuel the first seven (7) orifices 26 of the lower gas pipe 18 passes through these gaps. In fact, it has been found in practice that the gaps between the typical flat metallic strip 30 and the typical ⅜ inch pipe, when oriented as shown in FIG. 2, result in a much more proportionally correct gas distribution as compared to gas-fired burners without such a metallic strip 30. It will be understood by those skilled in the art, however, that there are variations in the interior surfaces of pipes, and in the trueness of edges of metallic strips. For this reason, it will also be understood by those skilled in the art that the metallic strip 30 may also be placed closer to the axial center of the lower pipe 18, if such placement should improve distribution in a given circumstance.

It has also been discovered by the inventors that a deflector band 36 made of the same material as metallic strip 3 is useful in reducing turbulence and directs the gas from upper tubular gas pipe 16 to lower tubular gas pipe 18. This reduction in turbulence and redistribution in the upper tubular gas pipe 16 is believed to result in a smoother, more controlled emission of gas from the orifices 28 of lower tubular gas pipe 18. The deflector band 36 is secured within the upper tubular gas pipe 16, and adjacent the junction 20. The deflector band 36 curves upwardly, and non-turbulently deflects gas within the upper tubular gas pipe 16 into the lower tubular gas pipe 18.

Figure 4:
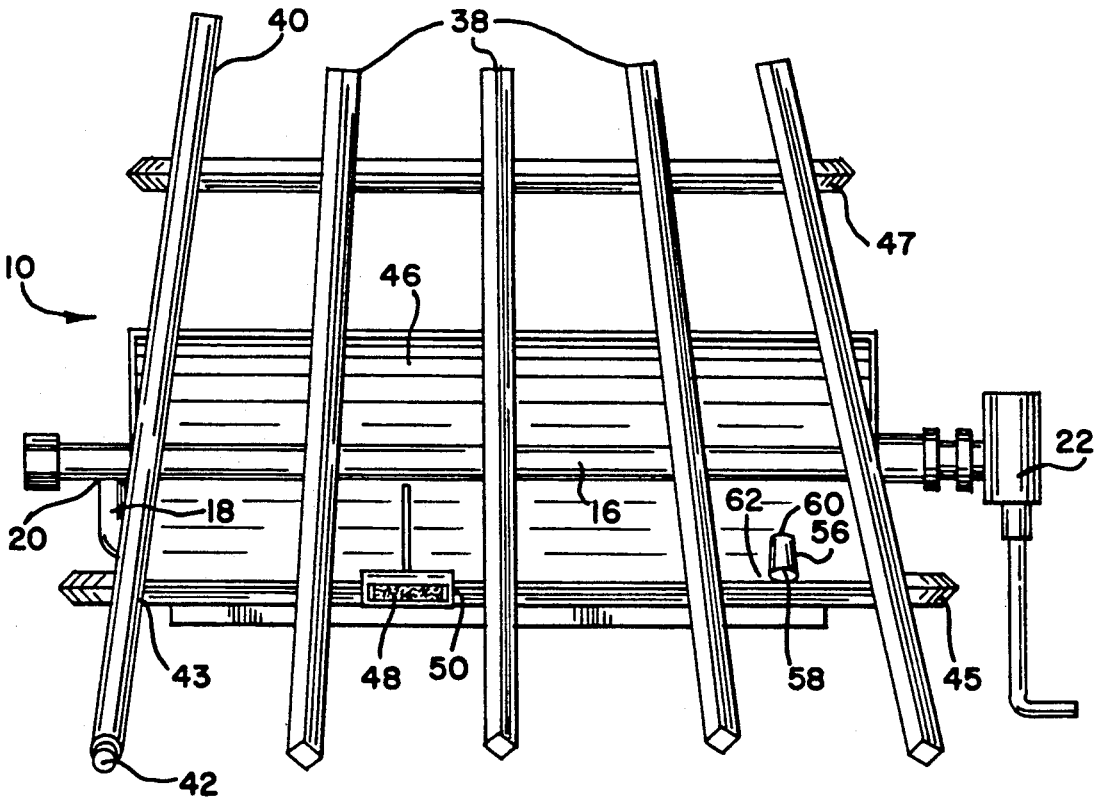
FIG. 4 is a top, perspective view of the gas-fired burner of FIG. 1.

The burner also has a plurality of crossbars 38 along its upper end, including at least one hollow crossbar 40. These crossbars 38 and 40 are heated during use of the burner. A scented stick 42 may be inserted into an open end 44 of the hollow crossbar 40. Where the burner pan, containing simulated wood and ashes, is welded to front 45 or rear support elements 47, a horizontally-disposed orifice 43 of 5/16 inch in diameter is drilled through the hollow crossbar 40, at the approximate position shown in FIG. 4. The center of this orifice 43 is about ½ inch forward of the front of a V-shaped trough 46, which will be described in more detail below. In this way, flames from the burner rise past the orifice 43 to ignite the scented stick 42, a portion of which is typically adjacent this orifice 43. As the scented stick 42 is heated to a smoldering temperature, it releases its aromatic components. Typically, these aromatic components smell like hardwoods or other aromatic woods used in conventional wood burning fireplaces.

Where the burner pan, containing simulated wood or ashes, is not secured to the support elements 45 and 47 or grate, then three (3) 5/16 inch horizontal orifices (not shown) are provided, rather than one orifice. These orifices are located in the crossbar 40 between the front 45 and rear support elements 47. They are positioned 1 inch, 2 inches, and 3 inches inward of the intersection of the crossbar 40 and the front support element 45.

As air within this hollow crossbar 40 is heated, it expands and exits through the open end 44 of that crossbar 40. That expanding, exiting air circulates the aromatic components of the scented stick 42 throughout the room.

The gas-fired burner of the invention may also include a conventional V-shaped trough 46. As yet another means of circulating the aromatic components of a scented stick 48, this V-shaped trough may include a generally C-shaped carrier 50 adjacent its upper end 52. The scented stick 48 may be inserted into this C-shaped carrier by bending one of its arms 54 outwardly. This bending increases the effective diameter of the C-shaped carrier 50, permitting easy insertion of the scented stick 48. After insertion of the scented stick 48, the arm 54 may be released so that it may reassume its original position and securely grip scented stick 48.

A further aspect of the invention is a generally elongated igniter 56. In this embodiment, the igniter 56 is secured near the upper end of one side of the V-shaped trough 46. In the most preferred embodiment, this igniter is made from a generally flat piece of metal that is rolled into an elongated shape having two generally oval-shaped ends 58 and 60. A gap 62 having a width of ⅛ inch extends along the length of this igniter 56. In the preferred embodiment, the first oval-shaped end 58 extends out from the sand which typically covers the gas-fired burner 10.

In lighting a conventional gas-fired burner, one generally must use a long match and stand well away from the burner itself. The head of the match would be placed near the orifices 26 of the upper tubular gas pipe 16. As a result, the ignition of the gas in such conventional burners could be sudden and startling. With the present igniter, the need to use such a long match is eliminated. Rather, a conventional match may be placed adjacent the first end 58 of the igniter 56. Gas being released from orifices 26 diffuses through the sand and towards the second end 60. Shortly after reaching this second end 60, the gas is ignited by the flame from the conventional match. This ignition takes place in a more controlled manner than with prior gas-fired burners.

In another embodiment, the first end of the igniter may be circular in shape, and the second end may be oval-shaped. In this second embodiment, the igniter does not utilize a gap.

While the specific embodiments have been illustrated and described, numerous modifications come to mind without markedly departing from the spirit of the invention. The scope of protection is thus only intended to be limited by the scope of the accompanying claims.

What I claim is:

1. In a gas-fired burner for a fireplace, an upper burner comprised of an upper tubular gas pipe and a lower burner comprised of a lower tubular gas pipe, said upper and lower tubular gas pipes meeting at a junction, wherein gas to said lower tubular gas pipe is fed through said upper tubular gas pipe, and wherein each of said tubular gas pipes has downwardly-facing, in-line orifices along their lengths, the improvement comprising a metallic strip having a width approximately equal to the inner diameter of said lower tubular gas pipe, said metallic strip secured at its ends across its width to the interior of said lower pipe, and extending from a point adjacent said junction to a point beyond approximately the first twenty-five to thirty-three percent (25–33%) of said in-line orifices in said lower tubular gas pipe, said metallic strip thereby causing a substantial portion of said gas to said lower tubular gas pipe to avoid said first 25–33% of said in-line orifices.

2. The gas-fired burner of claim 1, further comprising a deflector band secured within said upper tubular gas pipe and adjacent said junction, said deflector band curving upwardly to non-turbulently deflect gas within said upper tubular gas pipe into said lower tubular gas pipe.

3. The gas-fired burner of claim 1, further comprising a plurality of crossbars along its upper end, whereby said crossbars are heated during use of said burner, at least one of said crossbars being hollow to permit the insertion therein of a scented stick, whereby said scented stick releases its aroma upon heating, and whereby said aroma is circulated by air that is heated within said hollow crossbar, and exiting from an open end of said hollow crossbar.

4. The gas-fired burner of claim 1, further comprising a V-shaped trough, said V-shaped trough having a generally C-shaped carrier adjacent its upper end for the insertion of a scented stick.

5. In a gas-fired burner for use in a fireplace, said burner having a plurality of crossbars along its upper end, said crossbars being heated during use of said burner, the improvement comprising at least one of said crossbars being hollow to permit the insertion therein of a scented stick, whereby said scented stick releases its aroma upon heating, and whereby said aroma is circulated by air that is heated within said hollow crossbar, and exiting from an open end of said hollow crossbar.

6. In a gas-fired burner for use in a fireplace, said burner having a V-shaped trough, the improvement comprising a generally C-shaped carrier secured to the upper end of said V-shaped trough for the insertion of a scented stick.

7. In a gas-fired burner for a fireplace, an upper burner comprised of an upper tubular gas pipe and a lower burner comprised of a lower tubular gas pipe, said upper and lower tubular gas pipes meeting at a junction, wherein gas to said lower tubular gas pipe is fed through said upper tubular gas pipe, and wherein each of said tubular gas pipes has downwardly-facing, in-line orifices along their lengths, the improvement comprising a metallic strip having a width approximately equal to the inner diameter of said lower tubular gas pipe, said metallic strip secured at its ends across its width to the interior of said lower pipe, and extending from a point adjacent said junction to a point beyond approximately the first twenty-five to thirty-three percent (25–33%) of said in-line orifices in said lower tubular gas pipe, and further comprising a deflector band secured within said upper tubular gas pipe and adjacent said junction, said deflector band curving upwardly to non-turbulently deflect gas within said upper tubular gas pipe into said lower tubular gas pipe.

8. In a gas-fired burner for a fireplace, an upper burner comprised of an upper tubular gas pipe and a lower burner comprised of a lower tubular gas pipe, said upper and lower tubular gas pipes meeting at a junction, wherein gas to said lower tubular gas pipe is fed through said upper tubular gas pipe, and wherein each of said tubular gas pipes has downwardly-facing, in-line orifices along their lengths, the improvement comprising a metallic strip having a width approximately equal to the inner diameter of said lower tubular gas pipe, said metallic strip secured at its ends across its width to the interior of said lower pipe, and extending from a point adjacent said junction to a point beyond approximately the first twenty-five to thirty-three percent (25–33%) of said in-line orifices in said lower tubular gas pipe, and further comprising a V-shaped trough, said V-shaped trough having a generally C-shaped carrier adjacent its upper end for the insertion of a scented stick.

9. A combination grate and burner including a scent holder for holding a scented stick, said scent holder comprising at least one hollow crossbar forming part of said grate, said crossbar having at least one orifice, said hollow crossbar being heated during use of said burner, whereby flames from said burner rise past said orifice to ignite said scented stick.

10. The scent holder of claim 9, wherein said hollow crossbar is secured to front, and rear support elements of said combination grate and burner, and wherein said hollow crossbar includes one orifice adjacent said front support element.

11. The scent holder of claim 9, wherein said hollow crossbar is secured to front and rear support elements of said combination grate and burner, and wherein said hollow crossbar includes a plurality of orifices between said front and rear support elements of said combination grate and burner.

* * * * *

UNITED STATES PATENT AND TRADEMARK OFFICE

CERTIFICATE OF CORRECTION

PATENT NO. : 5,033,455

DATED : July 23, 1991

INVENTOR(S) : Scott F. Eiklor and Steve F. Eiklor

It is certified that error appears in the above-identified patent and that said Letters Patent is hereby corrected as shown below:

Column 3, line 52, delete "loWer" and insert --lower--.

Column 4, line 8, delete "3" and insert --30--.

Signed and Sealed this

First Day of December, 1992

*Attest:*

DOUGLAS B. COMER

*Attesting Officer*

*Acting Commissioner of Patents and Trademarks*